US006879104B2

(12) United States Patent
Tessier

(10) Patent No.: US 6,879,104 B2
(45) Date of Patent: Apr. 12, 2005

(54) STRUCTURE OF SUSTAIN ELECTRODES FOR THE FRONT TILE OF A PLASMA DISPLAY PANEL

(75) Inventor: Laurent Tessier, Fontaine (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/466,475

(22) PCT Filed: Dec. 21, 2001

(86) PCT No.: PCT/EP01/15393

§ 371 (c)(1),
(2), (4) Date: Jul. 1, 2003

(87) PCT Pub. No.: WO02/054439

PCT Pub. Date: Jul. 11, 2002

(65) Prior Publication Data

US 2004/0080269 A1 Apr. 29, 2004

(30) Foreign Application Priority Data

Jan. 2, 2001 (FR) ..... 01 00004

(51) Int. Cl.[7] ..... H01J 17/49

(52) U.S. Cl. ..... 313/582; 313/583; 313/584; 313/491; 313/631

(58) Field of Search ..... 313/582, 583, 313/584, 585, 491, 631

(56) References Cited

U.S. PATENT DOCUMENTS

| | | | | | |
|---|---|---|---|---|---|
| 5,742,122 | A | * | 4/1998 | Amemiya et al. | 313/582 |
| 6,157,355 | A | * | 12/2000 | Ide | 345/60 |
| 6,208,082 | B1 | * | 3/2001 | Kim et al. | 315/169.1 |
| 6,342,874 | B1 | * | 1/2002 | Tokunaga et al. | 345/68 |
| 6,348,762 | B1 | | 2/2002 | Nunomura et al. | 313/582 |
| 6,531,819 | B1 | * | 3/2003 | Nakahara et al. | 313/584 |
| 6,727,869 | B1 | * | 4/2004 | Kosaka | 345/60 |

OTHER PUBLICATIONS

Patent Abstracts of Japan, vol. 2000, No. 07, Sep. 29, 2000 And JP 2000–123748.

Search Report dated May 17, 2002.

* cited by examiner

*Primary Examiner*—Joseph Williams
*Assistant Examiner*—Kevin Quarterman
(74) *Attorney, Agent, or Firm*—Joseph S. Tripoli; Harvey D. Fried; Patricia A. Verlangieri

(57) ABSTRACT

Each sustain electrode of a pair includes a continuous ignition conductor, a bus without any overlap and without any direct contact with the latter, electrical connection between the ignition conductor and the bus, and a connector for spreading the discharge. This arrangement allows the luminous efficiency of sustained discharges to be increased.

10 Claims, 7 Drawing Sheets

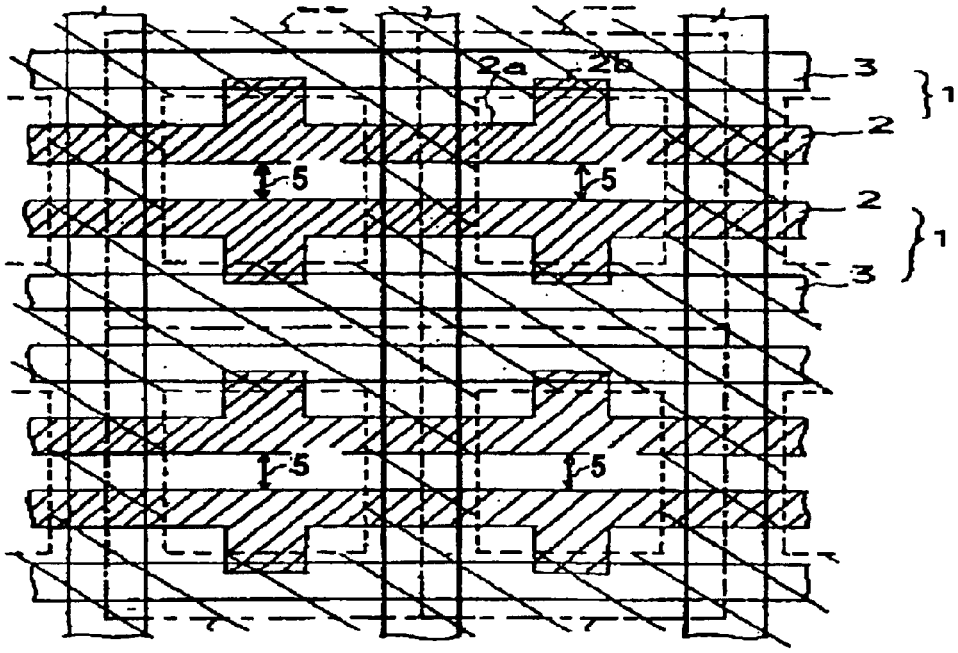
Fig.1 – PRIOR ART
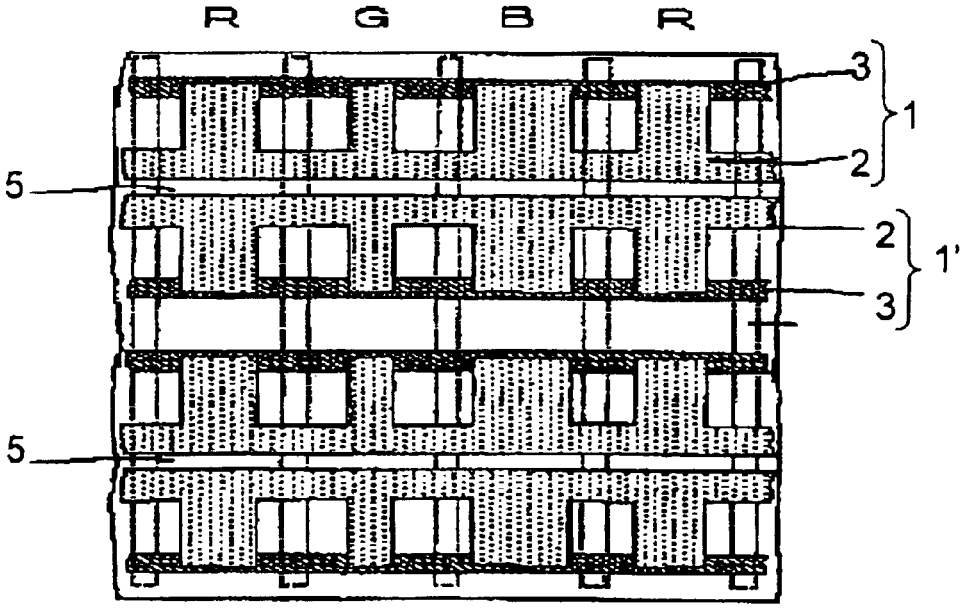
Fig.2 – PRIOR ART

STRUCTURE OF SUSTAIN ELECTRODES FOR THE FRONT TILE OF A PLASMA DISPLAY PANEL

CROSS-REFERENCE TO RELATED APPLICATIONS

This application claims the benefit, under 35 U.S.C. § 365 of International Application PCT/EP01/15393, filed Dec. 21, 2001, which was published in accordance with PCT Article 21(2) on Jul. 11, 2002 in English and which claims the benefit of French patent application No. 0100004, filed Jan. 2, 2001.

BACKGROUND OF THE INVENTION

The invention relates to a plasma display panel comprising:

a rear tile provided with an array of address electrodes;

a front tile, parallel to the first one, provided with an array of pairs of sustain electrodes leaving between them a sustain discharge gap, one of the electrodes of each pair being arranged with respect to an address electrode so as to leave between them, and between the tiles, address discharge spaces.

Such a panel is called a coplanar panel because the main direction of the sustain discharges is parallel to the tiles.

The intersections between the address electrodes and the pairs of sustain electrodes form discharge spaces between the tiles; these discharge spaces are in general bounded by barriers which themselves form an array and serve as spacers between the tiles.

The spaces bounded by these barriers form cells, the walls of which are in general coated with phosphors; these cells and the space between the tiles are filled with a low-pressure gas suitable for obtaining discharges which emit ultraviolet radiation.

When the display panel is in operation, electrical discharges are generated in the gas of the cells, which discharges emit ultraviolet radiation towards the phosphors on the walls of these cells; the phosphors, excited by this ultraviolet radiation, emit visible radiation through the front tile towards the person observing the image displayed by the panel.

In the case of panels emitting three primary colours, namely red, green and blue, the adjacent cells have phosphors of different colours so that discharges emitting indirectly in the red, green and blue are obtained.

To prevent the electrodes of the front tile absorbing too great a part of this visible radiation, these electrodes are preferably made in a material which is both conducting and transparent, such as tin oxide or a mixed indium-tin oxide (ITO); since these transparent electrodes are in general not sufficiently conducting, the arrays of transparent electrodes are "duplicated" with opaque metal conductors called buses, because they distribute the electric current for the discharge to the transparent electrodes.

A description of such arrays of sustain electrode pairs for a front tile will be found in documents JP 11-297214 by Pioneer (FIG. 1), JP2000-123748 by NEC (FIGS. 5 to 7) and EP 0 993 017 by Fujitsu (FIG. 11), these being repeated in FIGS. 1, 2 and 3 below; the discharge gaps 5 are bounded by the straight edges of the discharge ignition conductors 2, each connected via connection shunts 4 to a metal bus 3; in FIGS. 1 and 2, the ignition conductors 2 are continuous and transparent, the shunts 4 also being transparent; in all the figures, the metal conductors 3 are continuous, opaque and placed along the edges of the cells, or even beneath the barrier separating two cells, so as to absorb as little as possible of the radiation emitted by the phosphors.

In document EP 0 802 556 by Matsushita (FIGS. 7, 9), the connection shunts are placed between the discharge regions, above the barriers separating these regions, where they cannot participate in spreading the discharges.

Thus, it may be considered that each electrode 1, 1' of the sustain array described in these documents is in the form of a ladder, one of the rails of which corresponds to the transparent ignition conductor 2, the other rail of which corresponds to the metal conductor 3 and the rungs of which correspond to the shunts 4; such a configuration of sustain electrodes allows the luminous efficiency of the discharges to be improved.

This is because, when a sufficient electrical voltage (the sustain voltage) is applied between two electrodes 1, 1' of the same pair, a discharge is ignited in the gap 5 at the outer edge of the ignition conductor 2, over a front which can extend over the entire width of the cell in the lit state. After ignition, the discharge extends towards the bus 3 along the shunt 4 of this cell, the discharge thus spreading out in a general direction approximately perpendicular to the ignition front. The discharge front then narrows to the width of this shunt 4 and, because of this narrowing, the discharge advances towards the bus very rapidly. On reaching the bus 4, the discharge front widens again, the discharge reaching its maximum advance and its maximum extension, as shown schematically in the central cell of FIG. 3. As long as the transferred charges are insufficient to create a reverse potential, the discharge is sustained at this extended stage.

The use of wide electrodes is necessary in a coplanar structure in order to obtain a high efficiency in converting the electrical energy into light energy, since the luminous efficiency of the discharge is strongly related to its spread lengthwise and the luminance to its width. The longer the electrodes, in order to allow extensive spreading, the better the luminous efficiency will be.

The rapid spread of the discharge and the longest possible time for which it is sustained in the state of maximum extension are essential elements for improving the luminous efficiency of the discharge. The shunts 4 therefore serve as both means for electrically connecting the ignition conductors 2 to the metal buses 3 and as means for guiding and accelerating the propagation of the discharge. As discharge-spreading means, the shunts 4, whose width is very much less than that of the ignition front, are tailored in order to narrow the discharge front with respect to the ignition front; this narrowing is one means of reducing the electrical capacitance and makes it possible to accelerate the propagation of the discharge; other capacitance-lowering means, such as the localized increase in the thickness of the dielectric layer when it is present above the shunt, allow the propagation speed of the discharge to be increased.

Document EP 0 782 167 by Pioneer (FIG. 15) also describes an array of ladder-shaped sustain electrodes according to one particular embodiment. The width of the rungs 4 can vary, being narrow in the part which adjoins the ignition conductor 2 but much wider in the part which adjoins the bus 3 of the electrode.

SUMMARY OF THE INVENTION

It is an object of the invention to further improve the luminous efficiency of the discharges using an appropriate electrode configuration.

For this purpose, the subject of the invention is a front tile for a plasma display panel provided with an array of pairs of sustain electrodes leaving between them a sustaining discharge gap extending along the internal surface of this tile, the adjacent sustain discharge regions for the different primary colours being grouped together in pixels, in which each sustain electrode of a pair comprises:

a continuous ignition conductor, one of the edges of which faces the other lectrode of the pair and forms, in the event of a sustain discharge between the electrodes of the said pair, an ignition front of this discharge, a continuous conductor for distributing the discharge current, called a bus, placed facing the other edge of the ignition conductor, without any overlap and without any direct contact with the latter, means for electrically connecting the ignition conductor to the bus, characterized in that each sustain electrode (1, 1') has, in at least one sustain discharge region for each pixel (8), means for spreading the discharge in a general direction approximately perpendicular to the said ignition front, these means being independent of the said electrical connection means.

Conventionally, the linear electrical conductivity of the bus is greater than that of the ignition conductor; the bus is made of a highly conducting metallic material, such as silver; it is consequently opaque to light.

One of the simplest means to realize the invention starting from a sustain electrode configuration of the prior art in the form of a ladder, is to transform this ladder, by cutting at least one rung from one of the discharge regions of each pixel, by removing a central portion of this rung so that the two rung elements remaining are no longer contiguous. The rung thus cut no longer forms a means of connection between the ignition conductor and the bus. Although cut, the two rung elements remaining always form means for spreading the discharge. From the electrical standpoint, continuity of the electric field at the cut in the rungs is provided by the dielectric which covers the electrodes in the case of an AC panel with a memory effect.

As indicated above, it is important for the discharge to spread so as to obtain a "critical" size allowing a high luminous efficiency to be obtained. It is also important for the discharge to reach this size rapidly. The means of the prior art for spreading the discharge and for accelerating this spread would achieve this effect.

By virtue of this invention, it is also possible to slow down the spread of the discharge as soon as it reaches its critical size, that is to say at the cut, so as to increase the discharge time during the period of high efficiency.

The invention may also have one or more of the following features:

the discharge-spreading means are tailored in order to narrow the discharge front with respect to the ignition front so as to increase its rate of spread in the said direction.

The spreading means are therefore also means for accelerating this spread;

the said connection means are formed by conducting shunts connecting the said ignition conductor to the said bus, each sustain electrode preferably comprising at least one connection shunt for each pixel. Thus, in three successive discharge regions of the same pixel, only a single connection shunt may be found, this connection shunt being used to distribute the discharge electric current carried by the bus to the ignition conductor. Preferably, at least one discharge region of each pixel has no connection shunt;

preferably, since the primary colours conventionally include red, this connection shunt corresponding to a pixel also serves as a means for spreading the discharge region of the said pixel emitting indirectly in the red.

More specifically, for each pixel the shunt is then preferably placed in the emission windows of the red cell through the tile; this arrangement is particularly advantageous for correcting the colour temperature of the panel since, when the discharge gas contains neon, the discharge then produces a parasitic emission pink in colour, which reinforces the red component of the pixel. Greater opacification of the windows of the red cells, which results from placing this connection shunt therein, advantageously makes it possible to compensate for the enhancement of the red component and results in better colour rendition.

Another advantage of this arrangement of the shunt is that it reduces the alignment constraints in the process for manufacturing the tile and the panel. In the conventional case in which this shunt has to lay outside the emission windows of the cells, so as not to occlude them, the margin in the positioning operation is very small, which poses difficult alignment problems. In contrast, here, when this shunt is intentionally positioned in the red emission window, the margin in the positioning operation is much greater since it includes the entire width of the window;

the said spreading means independent of the connection means comprise, in the said sustain discharge region, at least one first projecting conductor extending from the ignition conductor towards the bus, without being connected thereto.

According to the examples given below, this projecting conductor may be of parallelepipedal shape. It may have any other shape suitable for the desired spreading effect, namely triangular, semicircular, etc.

The width of this projecting conductor may vary according to the cells. A larger-surface conductor may especially be placed in the red cells, so as to obstruct the windows of the red cells more than those of the other colours and to obtain the colour temperature correction effect of the panel described above.

Other means may be combined with this projecting conductor in order to vary the spread and the rate of spread of the discharge, such as variations in thickness of the dielectric layer, when the electrode array is covered with such a layer;

the said independent spreading means comprise, in the said sustain discharge region, at least one second projecting conductor extending from the bus towards the said first projecting conductor, without being connected thereto.

This therefore again results in a sustain electrode configuration in the form of a ladder with cut rungs, as described above, the remaining elements of the same cut rung forming the first and second projecting conductors. The cut in the rungs forms a feature which reduces the rate of spread of the discharge at the moment when this discharge has reached the critical size which produces high luminous efficiencies;

in at least one sustain discharge region, the said bus comes closer to the first projecting element without being connected thereto, so as to cooperate with this conductor as a spreading means independent of the connection means.

Preferably, the said ignition conductor is made of a metallic material, this being a significant economic advantage.

In general, the ladder-shaped electrode configuration as already described makes it possible to envisage producing the electrodes entirely from a metallic material opaque to light, since the gaps between the rungs form apertures wide enough to let through a high proportion of the light emitted by the phosphors.

If some rungs are cut according to the invention, this arrangement assumes only greater interest, as it further decreases the amount of light absorbed by the electrodes. Finally and above all, the use of entirely metallic electrodes is particularly economic compared with the other embodiment of the invention, in which the ignition conductor is made of a transparent material, since the techniques for manufacturing transparent conductors are much more expensive than those for conventional metallic conductors.

The subject of the invention is also a plasma display panel comprising:

a front tile according to the invention, a rear tile, placed parallel to the front tile so as to leave between the tiles a space filled with a discharge gas at low pressure.

Conventionally, such a panel is provided with an array of address electrodes, this generally being placed on the internal face of the rear tile so that each address electrode intersects each first or each second electrode of the sustain pairs, in order to leave address discharge spaces between them.

According to a variant, the array of address electrodes is also placed on the internal face of the front tile.

Such a panel generally includes an array of barriers, this being placed between the tiles so as, in particular, to act as spacers between the tiles and, at the very least, to separate the discharge regions of different colours.

BRIEF DESCRIPTON OF THE INVENTION

The invention will be more clearly understood on reading the description which follows, given by way of non-limiting example and with reference to the appended figures in which:

FIGS. 1 to 3, already mentioned, show ladder-shaped sustain electrode structures according to the prior art;

The figures take no account of the scale of values so as to better reveal certain details, which would not be clearly apparent if the proportions had been respected.

DETAILED DESCRIPTION

To simplify the description and demonstrate the differences and advantages that the invention has over the prior art, identical references will be used for the elements which provide the same functions.

Figure 4:
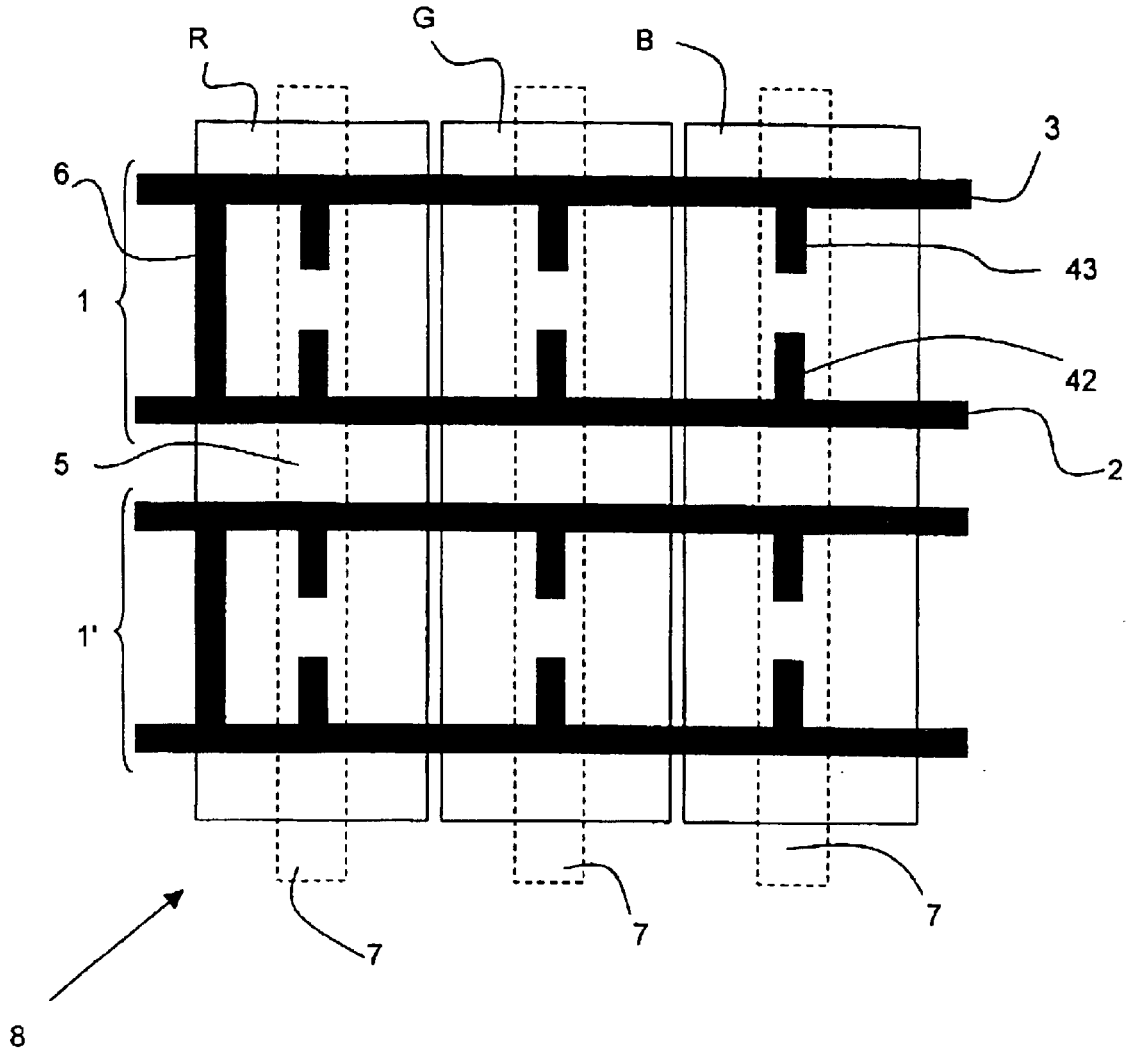
FIGS. 4 and 5 show a first embodiment of the invention, in which the spreading means of all the discharge regions are independent of the means for connecting the ignition conductor to the bus, in which the cells of the panel are conventionally placed in columns of uniform width.
Figure 5:
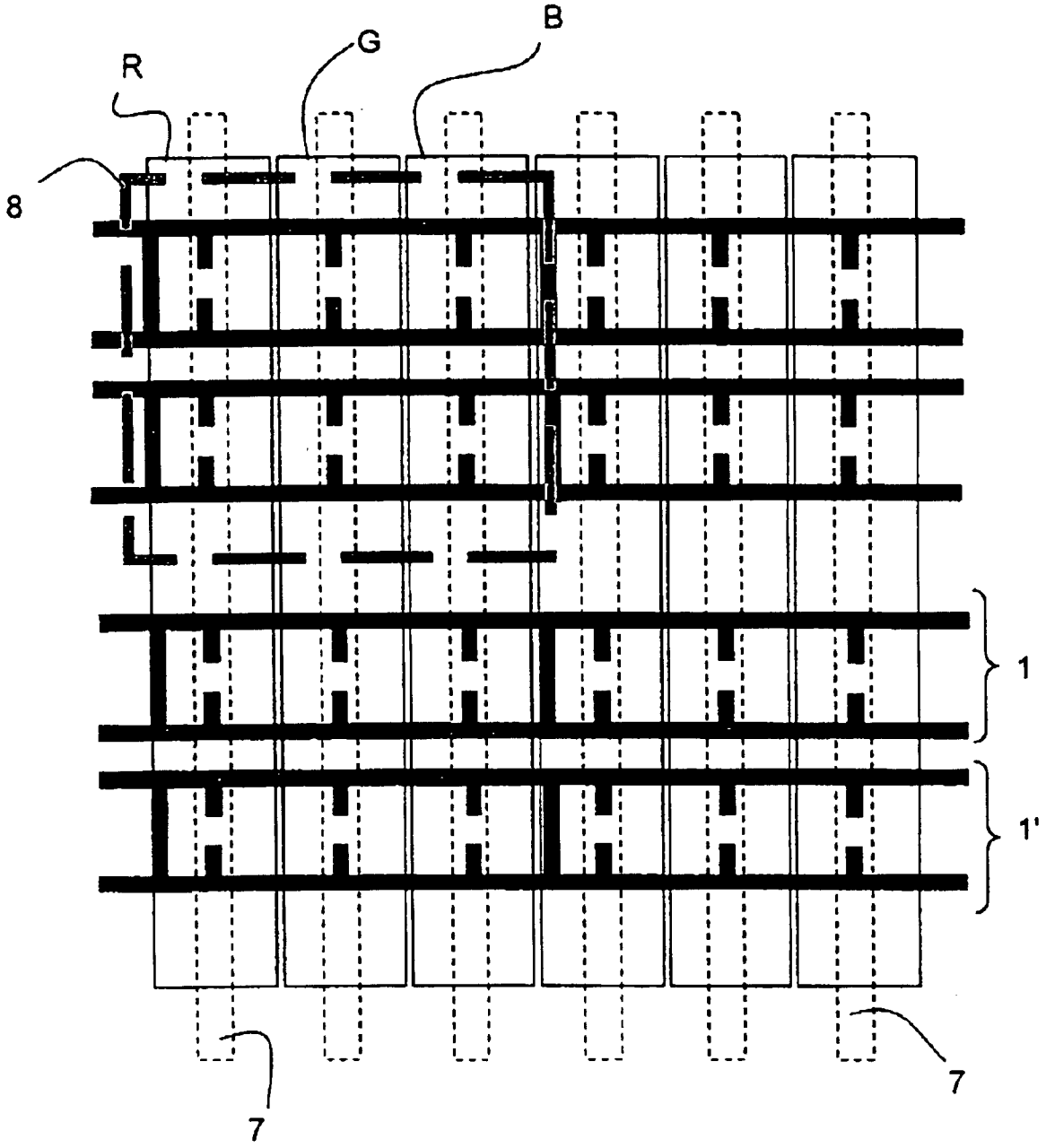

A first embodiment of the invention is shown in FIGS. 4 and 5.

FIG. 4 shows a pair of sustain electrodes in a region of a pixel 8 comprising three adjacent discharge regions R, G, B, this pair of electrodes being applied to the front tile of a plasma panel (not shown). The panel also includes a rear tile (not shown) which is provided with an array of address electrodes 7 (in dotted lines in the figure).

Figure 3:
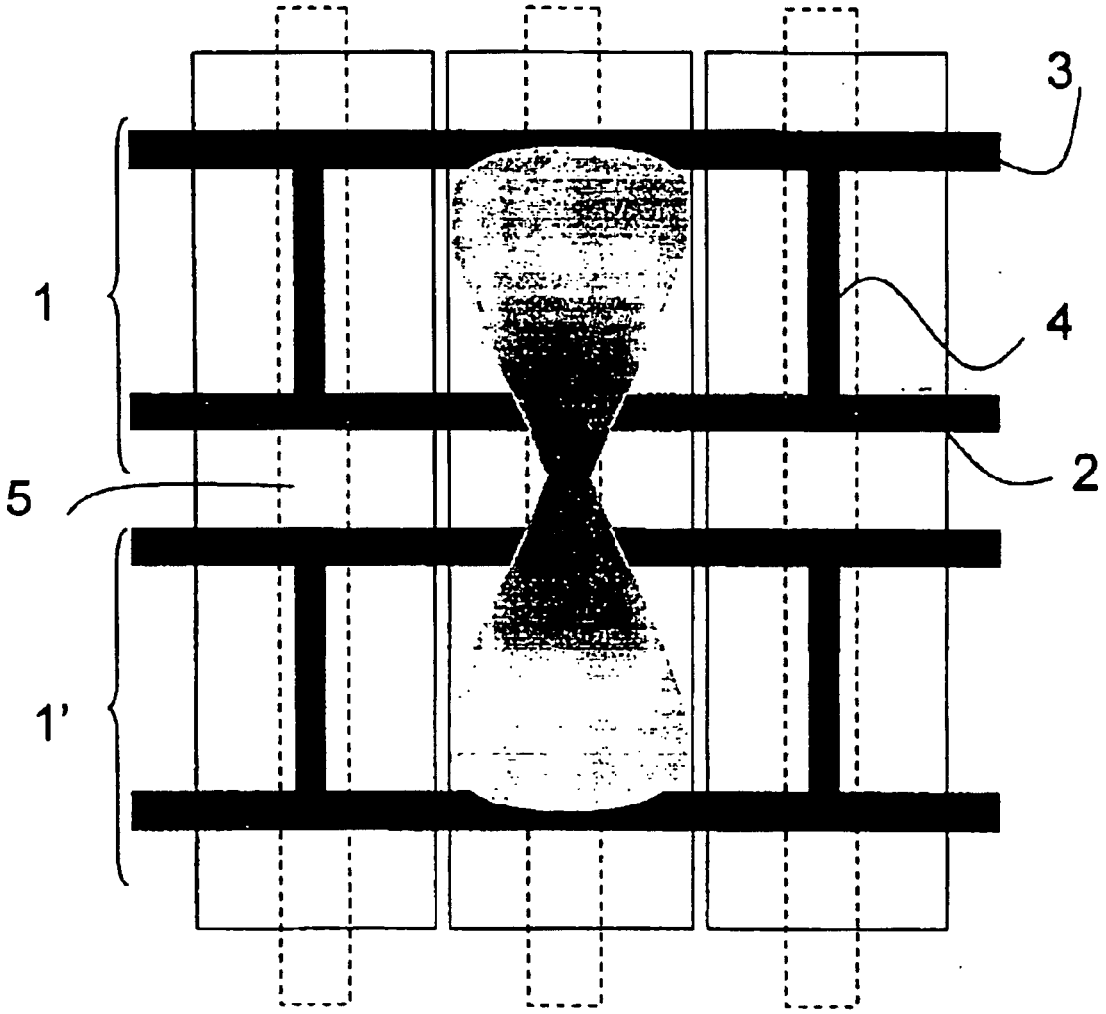
PRIOR ART Fig.3

As in the case of FIG. 3, described above and relating to the prior art, it may again been seen in FIG. 4 that each electrode 1, 1' of the pair is in the form of a ladder. All the conductors of each electrode are in this case made of an opaque metallic material, the sole differences compared with the pair of electrodes shown in FIG. 3 residing in the following aspects:

the conducting rungs are cut and their central part removed, their remaining a succession of first rung elements 42 connected to the ignition conductor 2 and, facing them, a succession of second rung elements 43 connected to the bus 3;

an additional rung 6 has been added for electrically connecting the ignition conductor 2 to the bus 3.

The cut made in the rungs advantageously slows down the spread of the discharge as soon as it reaches the end of the first rung elements 42. These first rungs form projecting conductors extending from the ignition conductor 2 towards the bus 3, without being connected thereto. Advantageously, the length of the first rung elements 42 is tailored so that a discharge spreading as far as the free end of this element has a size sufficient to obtain a high luminous efficiency. Thus, a pair of electrodes 1, 1' is obtained which not only allows the discharge to rapidly spread, as in the prior art, but also, thanks to the cuts, allows this spread to be slowed down when this discharge reaches its maximum luminous efficiency. According to the invention, the cuts very substantially improve the luminous efficiency of the discharge.

Without departing from the invention, the ignition conductors 2 and the first rung elements 42 may be made of a transparent conducting material, such as tin oxide or ITO.

If the electrode is made entirely of an opaque metallic material, the cuts made in the rungs make it possible to limit the absorption of light by the electrodes. The economic advantage provided by this solution is then less penalized than in the prior art by occlusion of the cells of the panel by the electrodes.

As shown in FIG. 4, in a preferred embodiment of the invention, this connection rung 6 has been placed so as to partly occlude the region R emitting in the red, close to the edge of this region. Thus, a pixel 8 is obtained whose red component is depleted, thereby making it possible to correct for the contrary effect of enrichment in the red resulting from emissions specific to neon, which is generally contained in the discharge gas.

Figure 6:
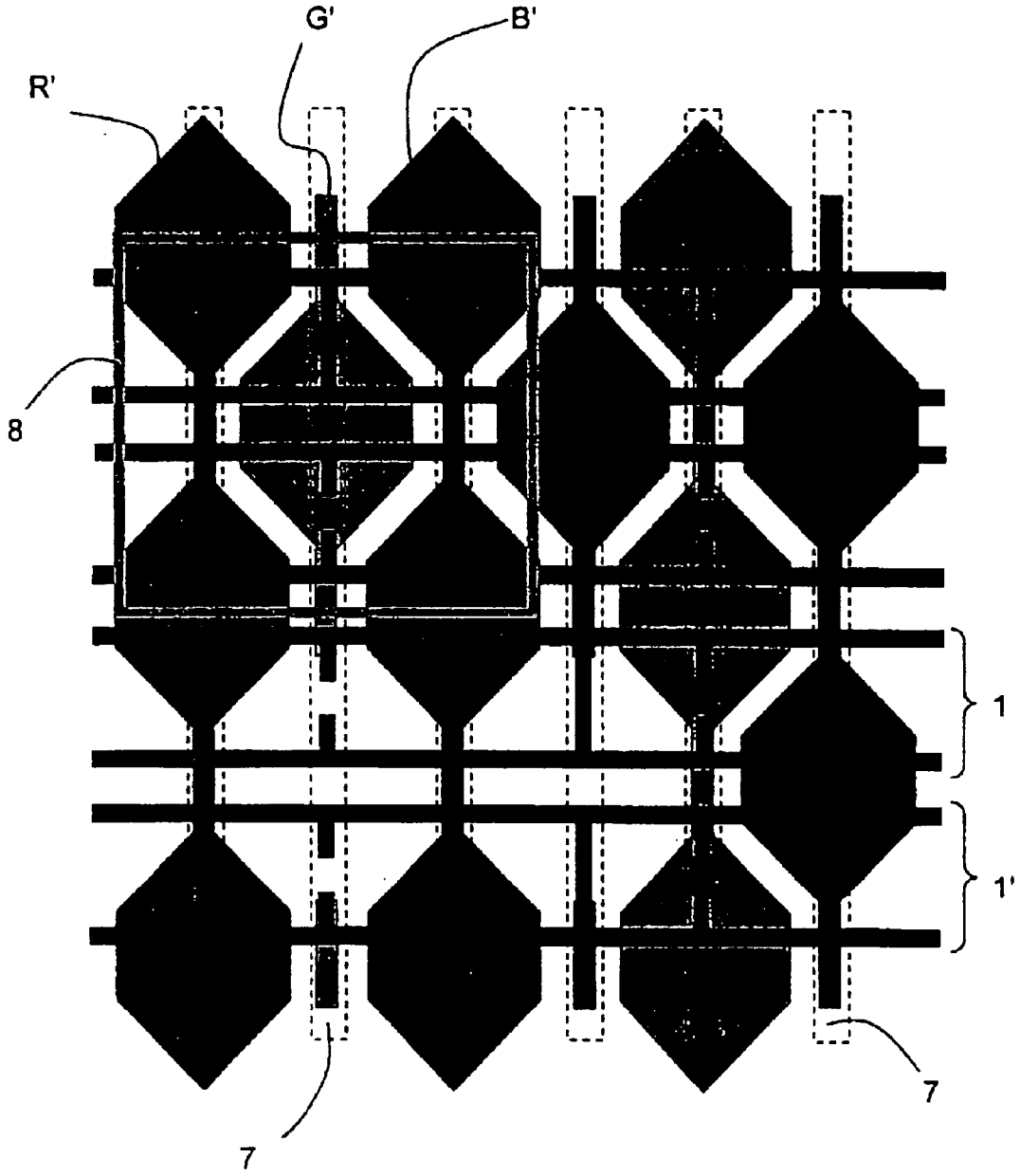
FIG. 6 shows the same embodiment of an array of pairs of sustain electrodes as in FIGS. 4 and 5, but applied here to a plasma panel whose cells are arranged in a staggered fashion.

FIG. 5 shows a succession of pixels 8 for a panel in which the discharge regions of the same colour R, G, B are grouped together in columns of uniform width separated by barriers (not shown). FIG. 6 shows the use of electrodes 1, 1', which are again identical, in a plasma panel whose discharge cells have a hexagonal shape.

Figure 7:
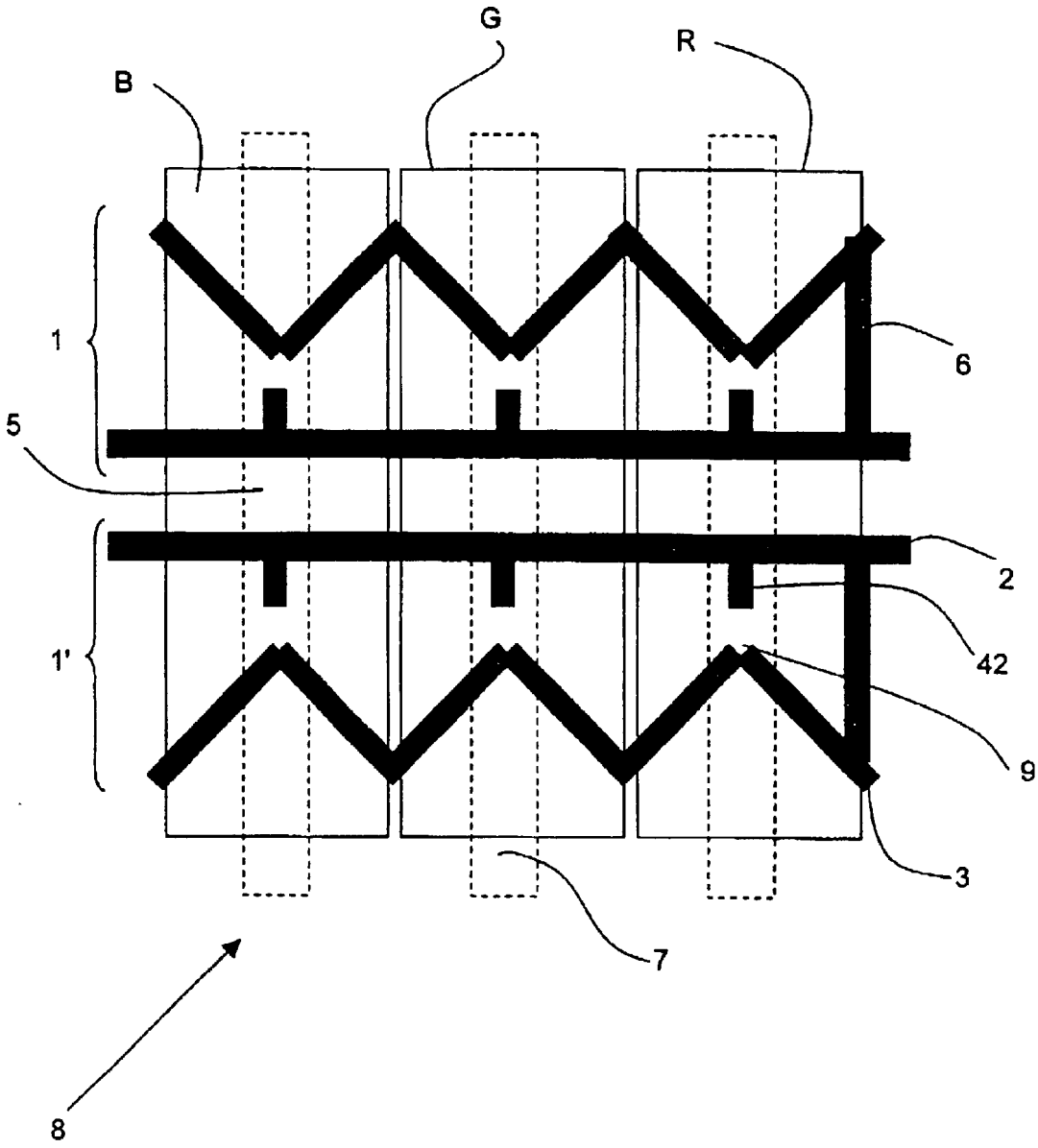
FIG. 7 shows a second embodiment of the invention, in which the spreading means of all the discharge regions are also independent of the means for connecting the ignition conductor to the bus.

FIG. 7 shows a pixel 8 in which, instead of the second rung elements 43, the bus 3 presents sinuosities 9 bringing it closer to the first rung elements 42 in each discharge region, without them being connected. The sinuosities 9 in the path that the bus 3 then follows on the front tile collaborate with the first elements 42 of the ignition conductor 2 in order to form means for spreading the discharge which, according to the invention, reduce the rate of this spread when the discharge has reached a size sufficient to obtain a high luminous yield.

According to another variant (not shown) of the invention, the bus 3 is both provided with sinuosities 9 and with second rung elements 43 extending, each from a sinuosity 9, towards a first rung element 42, without being connected thereto.

Figure 8:
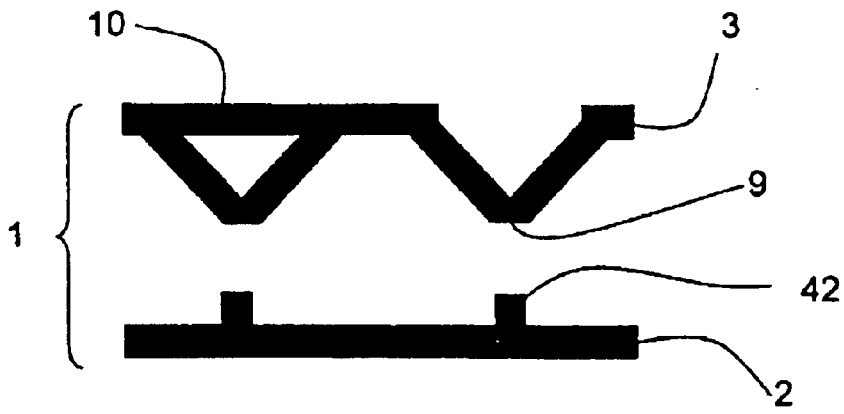
FIGS. 8 and 9 show other variants according to the invention of one of the electrodes of a sustain pair.
Figure 9:
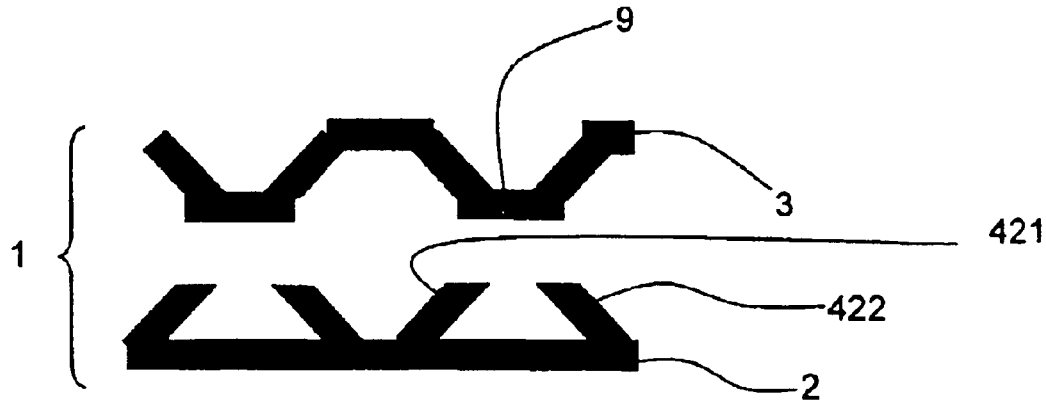

Other variants relating to the electrodes 1 are shown in FIGS. 8 and 9.

FIG. 8 shows an electrode portion 1 identical to that shown in FIG. 7, except that certain sinuosities 9 of the bus 3 are short-circuited by elements 10 so as to increase the linear conductivity of the bus.

According to the variant shown in FIG. 9, each first rung element 42 of FIG. 7 is replaced with two oblique elements 421 and 422 suitable for forming two first projecting conductors extending from the ignition conductor 2 towards a sinuosity 9 of the bus 3, without being connected thereto. Such an electrode 1 offers advantages comparable to those offered by the previously described electrodes of the invention.

To produce plasma panels provided with front tiles according to the invention, the following steps may for example be carried out in a conventional manner:

the array of sustain electrodes that has just been described is applied to a transparent soda-lime glass plate, for example by well-known photolithographic techniques;

a green layer based on a transparent dielectric is deposited on the front tile provided with this array of electrodes;

the assembly is fired, so as to remove the organic components from the electrode and dielectric layers, to sinter the conducting material of the electrode layer and to densify the dielectric layer; and the protective layer based on MgO is applied.

A rear tile provided with an array of address electrodes and an array of barriers is prepared in a conventional manner elsewhere.

The two tiles are joined together in a conventional manner, the air contained between the tiles is evacuated, the panel is filled with the discharge gas at low pressure and then the panel is sealed.

To control the operation of the plasma panel thus obtained, a system for supplying and controlling the electrodes of the panel is employed in a conventional manner.

What is claimed is:

1. Front tile for a plasma display panel provided with an array of pairs of sustain electrodes leaving between them a sustain discharge gap extending along the internal surface of this tile, the adjacent sustain discharge regions for the different primary colours being grouped together in pixels, in which each sustain electrode of a pair comprises:

a continuous ignition conductor, one of the edges of which faces the other electrode of the pair and forms, in the event of a sustain discharge between the electrodes of the said pair, an ignition front of this discharge, a continuous conductor for distributing the discharge current, called a bus, placed facing the other edge of the ignition conductor, without any overlap and without any direct contact with the latter, means for electrically connecting the ignition conductor to the bus, wherein each sustain electrode has, in at least one sustain discharge region for each pixel, means for spreading the discharge in a general direction approximately perpendicular to the said ignition front, these means being independent of the said electrical connection means.

2. Tile according to claim 1, characterized in that wherein these discharge-spreading means are tailored in order to narrow the discharge front with respect to the ignition front so as to increase its rate of spread in the said direction.

3. Tile according to claim 1, wherein the said connection means are formed by conducting shunts connecting the said ignition conductor to the said bus.

4. Tile according to claim 3, each sustain electrode includes at least one connection shunt for each pixel.

5. Tile according to claim 4, wherein, since the primary colours include red, the said connection shunt corresponding to a pixel also serves as a means for spreading the discharge region of the said pixel emitting indirectly in the red.

6. Tile according to claim 1, wherein the said spreading means independent of the connection means comprise, in the said at least one sustain discharge region, at least one first projecting conductor extending from the ignition conductor towards the bus, without being connected thereto.

7. Tile according to claim 6, wherein the said independent spreading means comprise, in the said at least one sustain discharge region, at least one second projecting conductor extending from the bus towards the said first projecting conductor, without being connected thereto.

8. Tile according to claim 6, wherein, in the said at least one sustain discharge region, the said bus comes closer to the first projecting conductor without being connected thereto, so as to cooperate with this conductor as a spreading means independent of the connection means.

9. Tile according to claim 1, wherein the said ignition conductor is made of a metallic material.

10. Plasma display panel comprising:

a front tile according to claim 1;

a rear tile, placed parallel to the front tile so as to leave between the tiles a space filled with a discharge gas at low pressure.

* * * * *